US010041316B2

(12) United States Patent
Dugas

(10) Patent No.: US 10,041,316 B2
(45) Date of Patent: Aug. 7, 2018

(54) COMBINED SURFACE AND DOWNHOLE KICK/LOSS DETECTION

(71) Applicant: Bryan C. Dugas, Breaux Bridge, LA (US)

(72) Inventor: Bryan C. Dugas, Breaux Bridge, LA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 312 days.

(21) Appl. No.: 14/740,831

(22) Filed: Jun. 16, 2015

(65) Prior Publication Data

US 2016/0369581 A1 Dec. 22, 2016

(51) Int. Cl.

| | |
|---|---|
| ***E21B 21/08*** | (2006.01) |
| ***E21B 47/12*** | (2012.01) |
| ***E21B 47/06*** | (2012.01) |

(52) U.S. Cl.

CPC ..... *E21B 21/08* (2013.01); *E21B 47/06* (2013.01)

(58) Field of Classification Search

CPC ..... E21B 47/06; E21B 49/00; E21B 21/08; E21B 47/12; E21B 49/008

See application file for complete search history.

(56) References Cited

U.S. PATENT DOCUMENTS 5,154,078 A 10/1992 Codazzi
6,234,250 B1 5/2001 Green et al.
6,820,702 B2 * 11/2004 Niedermayr ..... E21B 21/08 175/24
2007/0151762 A1 7/2007 Reitsma
2013/0087388 A1 * 4/2013 Veeningen ..... E21B 47/10 175/48
2013/0168100 A1 * 7/2013 Judge ..... E21B 21/08 166/336
2013/0325351 A1 * 12/2013 Haberer ..... E21B 49/08 702/12

(Continued)

OTHER PUBLICATIONS

Notification of Transmittal of the International Search Report and the Written Opinion of the International Searching Authority, or the Declaration; PCT/US2016/037804; dated Sep. 27, 2016; 14 pages.

(Continued)

*Primary Examiner* — Mohamed Charioui
*Assistant Examiner* — Jeremy Delozier
(74) *Attorney, Agent, or Firm* — Cantor Colburn LLP

(57) ABSTRACT

A method for verifying that a kick or loss detected by surface monitoring equipment has occurred includes: receiving an input signal having notification that a kick or a loss has been detected in an earthen borehole during a time interval when drilling fluid is not being pumped into a drill string disposed in the borehole; sensing a pressure in the borehole to provide sensed pressure readings; comparing the sensed pressure readings to an upper threshold and a lower threshold; verifying that a kick has occurred if the notification comprises a kick detection and the sensed pressure reading are above the upper threshold; verifying that a loss has occurred if the notification comprises a loss detection and the sensed pressure readings are below the lower threshold; and transmitting a kick or loss verification signal to a signal receiving device upon verification that the kick or loss has occurred.

17 Claims, 8 Drawing Sheets

(56) References Cited

U.S. PATENT DOCUMENTS

2014/0214325 A1 7/2014 Wessling et al.

OTHER PUBLICATIONS

Ward. et al.; "Kick detection, well control, and formation "flow-back" interpretation now more effective";Off-Shore Magazine; 1999; Pennwell Corporation, Tulsa OK; Retreived from the Internet; URL: http://http://www.offshore-mag.com/articles/print/volume-59/issue-7/departments/drilling-production/kick-detection-well-control-and-formation-flow-back-interpretation-now-more-effective.html; 7 pages.

* cited by examiner

COMBINED SURFACE AND DOWNHOLE KICK/LOSS DETECTION

BACKGROUND

When drilling a wellbore in a formation, drilling fluid is circulated from a surface location to a downhole location by being pumped downward through an inside of a drill string and back to the surface by flowing upward in an annulus between the drill string and the wellbore. When pumping stops, a certain amount of drill fluid, often between 20 to 50 barrels, flows back to the fluid holding tanks due to elasticity of the formation. This is known as flowback. Such flowback, when shutting off the pumps is considered normal. However, an amount of flowback higher or lower than expected may occur depending on characteristics of the formation. "Kick" refers to the higher than expected flowback situation while "loss" refers to the lower than expected flowback situation. A kick may occur during such occasions in which fluid flows into the wellbore from the formation. If this formation fluid flow into the wellbore occurs in an uncontrollable manner, an undesirable event referred to as a blowout may occur. In a loss situation, drill fluid may flow from the wellbore into crevices and crack in the formation caused by drilling. Thus, early detection of kicks or losses is of particular interest to drilling operators.

BRIEF SUMMARY

Disclosed is a method for verifying that a kick or loss detected by surface monitoring equipment has occurred. The method includes: receiving, with a verifier controller, an input signal having notification that a kick or a loss has been detected in a borehole penetrating the earth during a time interval when drilling fluid is not being pumped into a drill string disposed in the borehole, the kick or loss being detected by the surface equipment; sensing a pressure in the borehole using a pressure sensor disposed in the borehole on the drill string to provide sensed pressure readings; comparing the sensed pressure readings to an upper threshold and a lower threshold using the verifier controller; verifying that a kick has occurred if the notification comprises a kick detection and the sensed pressure reading are above the upper threshold using the verifier controller; verifying that a loss has occurred if the notification comprises a loss detection and the sensed pressure readings are below the lower threshold using the verifier controller; and transmitting, using the verifier controller, an output signal to a signal receiving device upon verification that the kick or loss has occurred, the signal comprising verification of the kick or loss.

Also disclosed is an apparatus for verifying that a kick or loss detected by surface monitoring equipment has occurred. The apparatus includes a pressure sensor disposed in a borehole on a drill string and configured to sense pressure to provide sensed pressure readings and a verifier controller. The verifier controller is configured to: receive an input signal comprising notification that a kick or a loss has been detected in a borehole penetrating the earth during a time interval when drilling fluid is not being pumped into the drill string disposed in the borehole, the kick or loss being detected by the surface equipment; compare the sensed pressure readings to an upper threshold and a lower threshold; verify that a kick has occurred if the notification comprises a kick detection and the sensed pressure reading are above the upper threshold using the processor; verify that a loss has occurred if the notification comprises a loss detection and the sensed pressure readings are below the lower threshold using the processor; and transmit an output signal to a signal receiving device upon verification that the kick or loss has occurred, the signal having verification of the kick or loss.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are apparatus and method for verifying that a kick or loss detected by surface monitoring equipment during a time interval when drill fluid is not being pumped downhole is in fact a kick or loss. In one or more embodiments, the surface monitoring equipment monitors drill fluid flowback and determines if the flowback exceeds a high level threshold to issue an alert that a kick is detected or if the flowback is less than a threshold to issue an alert that a loss is detected. Data from downhole sensors, generally pressure sensors, can then be used to verify or confirm the kick or loss.

Figure 1A:
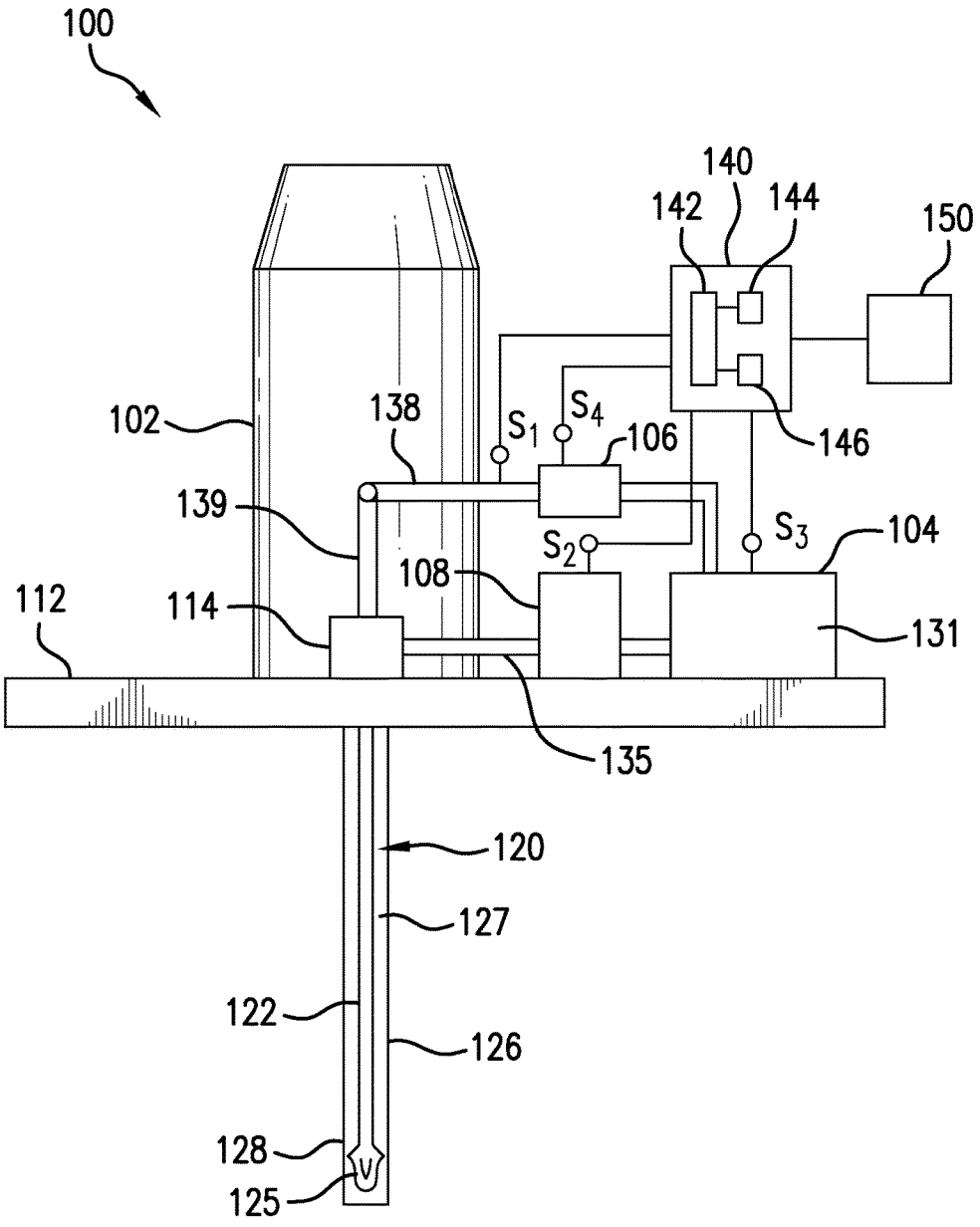
FIGS. 1A and 1B, collectively referred to as FIG. 1, show a schematic diagram of an exemplary drilling system is suitable for use with the present disclosure.

FIG. 1 shows a schematic diagram of an exemplary drilling system 100 that is suitable for use with the present disclosure. Referring to FIG. 1A, the exemplary drilling system 100 includes a drillstring 120 carrying a drill bit 125 conveyed in a "wellbore" or "borehole" 126 for drilling the wellbore. The drilling system 100 includes a conventional derrick 102 erected on a floor 112 which supports a rotary table 114 that rotates the drillstring 120. The drillstring 120 includes tubing such as a drill pipe or a coiled-tubing 122 extending downward from the surface into the borehole 126. The drill bit 125 attached to the end of the drillstring 120 breaks up geological formations when it is rotated to drill the borehole 126. During drilling operations, a downward force is applied to the drillstring 120 to advance the drillstring 120 into the borehole 126.

During drilling operations, a suitable drilling fluid 131 from a drilling fluid storage system 104 is circulated under pressure through a channel in the drillstring 120 by a mud pump 106. The drilling fluid 131 passes from the mud pump 106 into the drillstring 120 via a desurger (not shown), fluid line 138 and Kelly joint 139. The drilling fluid 131 is discharged at the borehole bottom 128 through an opening in the drill bit 125. The drilling fluid 131 circulates uphole through an annular space 127 between the drillstring 120 and the borehole 126 and returns to the drilling fluid storage system 104 via a return line 135 and return system 108. The drilling fluid acts to lubricate the drill bit 125 and to carry borehole cutting or chips away from the drill bit 125. A sensor $S_1$ placed in the fluid line 138 provides information about the fluid flow rate. In addition, similar information is provided via a sensor $S_2$ placed at the return system 108 and/or sensor $S_3$ placed at the drilling fluid storage system 104. Sensors $S_1$, $S_2$ and $S_3$ can provide information such as fluid flow rate, fluid volume, and/or fluid volume change rates. Other sensors providing this information can also be disposed at various locations along the flow of the drilling fluid. Sensor $S_4$ is provided at pump 106 to measure pump rates and pump pressure. Signals from sensors $S_4$ can be used to determine a "pumps off" event when the drilling pump 106 is turned off, indicating an onset of flowback.

The exemplary drilling system 100 further includes a surface control unit 140 and a display and alarm system 150 configured to provide information relating to the drilling operations and for controlling certain aspects of the drilling operations. In one aspect, the surface control unit 140 can be a computer-based system that includes one or more processors (such as microprocessors) 142, one or more data storage devices (such as solid state-memory, hard drives, tape drives, etc.) 144 for storing programs or models and data, and computer programs and models 146 for use by the processor 142. In one aspect, the surface control unit 140 receives signals from the sensors $S_1$-$S_4$ and processes such signals according to programmed instructions at the surface control unit 140. The surface control unit 140 calculates various values disclosed herein and displays these values and information at the display and alarm system 150. In one embodiment, the surface control unit 140 receives flow rate data and/or rate of change in volume and outputs a data set that includes flow rate averages and standard deviations to the display and alarm system 150. The display and alarm system 150 triggers an alarm, also referred to herein as a "smart alarm," such as a visual or audible indication, when a selected alarm condition is met, as discussed below. In another embodiment, the display and alarm system 150 provides a signal to the control unit 140 when the alarm condition is met and verified and the control unit 140 performs an action to address the alarm condition, for instance, an action that reduces the influx. The display and alarm system 150 can also provide the alarm signal to an operator to prompt the operator into taking an action. In one or more embodiments, the display and alarm system 150 includes a logical AND circuit 151 configured to transmit an alarm signal to either a user or to the control unit 140 when both the kick or loss detection signal AND the kick or loss verification signal are received by the display and alarm system 150.

Figure 1B:
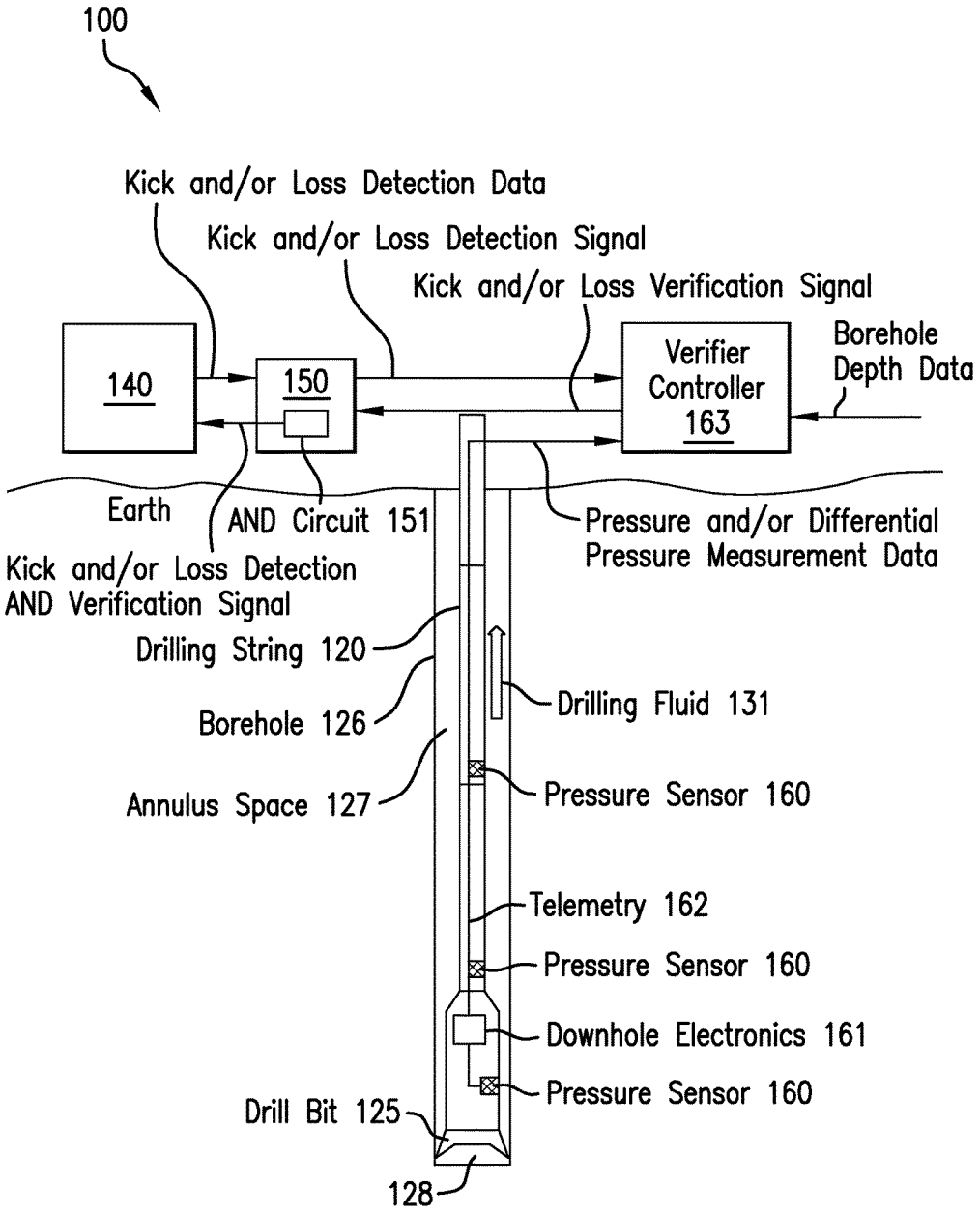

Referring to FIG. 1B, the drilling system 100 includes one or more pressure sensors 160. Each pressure sensor 160 is configured to sense pressure in the annulus (i.e., between the drill string and the borehole wall) or to sense differential pressure between the annulus pressure and the drilling fluid pressure in the interior of the drill string. Downhole electronics 161 are coupled to the one or more pressure sensors 160 and are configured to receive pressure readings from the pressure sensors generally at a prescribed rate such as every two seconds for example. The downhole electronics 161 are further configured to store the pressure readings in memory or a storage medium and to act as an interface with telemetry 162 for transmitting the pressure readings to a verifier controller 163. Non-limiting embodiments of the telemetry 162 include mud-pulse telemetry and wired drill pipe as they are known in the art. In embodiments where the telemetry is mud-pulse telemetry, the pressure readings may be stored while the drilling fluid is not being flowed in the drill string (i.e., flow off condition) such as when a drill pipe connection is being made and then transmitted to the verifier controller 163 when drilling fluid flow is restored. In embodiments where the telemetry is wired drill pipe, the pressure readings may be transmitted to the verifier controller 163 as soon as they are received in real time. The verifier controller 163 is configured to implement a verifier algorithm to verify or confirm alarm conditions triggered by the display and alarm system 150. The verifier algorithm is discussed in more detail further below.

In a normal flowback, the drilling fluid from the surface equipment and return lines 135 drains back to the fluid storage system once the pump is shut off However, when the hydrostatic pressure exerted on the formation by the drilling fluid column is insufficient to hold the formation fluid in the formation, the formation fluid can flow into the borehole. This influx of formation fluid into the wellbore is known as a kick, and is generally undesirable. In addition, when the downhole drilling fluid pressure is greater than the formation fluid pressure, drilling fluid can infiltrate the formation. This drilling fluid infiltration is known as a loss and is also undesirable.

The present disclosure provides a system for detecting a flowback event that lies outside a normal flowback condition, such as a kick or a loss, and for triggering an alarm or automatically performing an action when such an abnormal flowback is detected. The system further provides for verifying or confirming the alarm using sensor data obtained downhole. In one embodiment, statistics are obtained for parameter measurements obtained during prior flowbacks, and the values of the current flowback are compared to the obtained statistics in order to determine whether or not a current flowback parameter is a normal flowback. In various embodiments, determining the statistics includes determining an average value and a standard deviation for the previous flowbacks. In various embodiments, the average value can be an arithmetic mean, a geometric average, a weighted average or any other average obtained by suitable methods. In addition, an alarm level indicating when the flowback volume is outside of a normal flowback region can be set at one standard deviation from the average value, two standard deviations from the average value or any selected multiple of standard deviations from the average value. In general, the average value and standard deviation are determined from N previous flowbacks. Thus, the average is a moving average in which the oldest flowback is dropped from the averaging process once a new flowback is recorded. In another embodiment, flowbacks within a selected time period prior to the current flowback are used in determining the average value and standard deviation.

When the pump is turned off, sensors $S_1$, $S_2$ and $S_3$ measure various flow parameters, such as flow rate, pit volume total and rate of change in pit volume with time (i.e. flowback). These measured flow parameters are communicated to surface control unit 140 that performs the methods described herein. These flow parameters are obtained at a sampling interval that can be selected by an operator, thereby providing a data set of parameters obtained at $t_0, t_1, \ldots, t_M$, wherein time is measured from the start of the flowback. In an exemplary embodiment, the selected sampling interval is about 2 seconds. For each sampling interval, a dataset is saved to the control unit 140 and becomes available to the display and alarm system 150. The data set generally includes time and current parameter values as well as calculated averages and standard deviations.

Average values are calculated for each sampling interval $t_0, t_1, \ldots, t_M$, and the average values for each sampling interval are plotted against time at the display and alarm system 150 to produce a curve that represents an average or "normal" flowback. The average value at a selected sampling interval is determined using values from corresponding sampling intervals in the last N flowback curves. For example, the average value of a flowback parameter at 60 seconds after the onset of flowback is determined using measurements from the previous N flowback parameters that were obtained at 60 seconds after the onset of their respective flowbacks. In one embodiment, the average value is an arithmetic mean, as shown in Eq. (1):

$$\mu = \frac{1}{N}\sum_{i=1}^{N} x_i \qquad \text{Eq. (1)}$$

where $x_1, x_2, \ldots, x_N$ are the last N flowback data samples, with $x_1$ being the most recent flowback sample and $x_N$ being the oldest flowback sample. In one embodiment, this average (and subsequent standard deviation) is calculated by excluding special events like kicks, flowchecks, SCR's (slow circulation rates), etc. In one embodiment, the value of N is selected to be 7. However, the number N can be any number that is suitable to an operator.

Smart alarm curves can be defined using the average μ plus or minus a multiple of statistical deviations. The standard deviation is generally obtained using Eq. (2):

$$\sigma = \sqrt{\frac{1}{N}\sum_{i=1}^{N}(x_i - \mu)^2} \qquad \text{Eq. (2)}$$

where μ is the average of the last N flowback samples at a given elapsed time since the onset of flowback. Having calculated flowback averages and standard deviations, the control unit 140 supplies a dataset to the display and alarm system 150 and curves representative of the dataset values are plotted at the display and alarm system 150. The data set can include time, current value, μ, μ+σ, μ−σ, μ+2σ and/or μ−2σ. In addition, the dataset can include μ+Δσ and/or μ−Δσ where Δ is a positive number that can be selected by an operator. The smart alarm can be set to correspond to any of the curves μ+σ, μ−σ, μ+2σ, μ−2σ, μ+Δσ and μ−Δσ according to the operator's selection. Alternatively, the smart alarm can be set at a curve related to any other deviation value, i.e., an average absolute deviation, a mean average deviation, etc. Regardless of which curve is used as selected alarm limit, an alarm is triggered when a current flowback parameter crosses from a region that is indicative of normal flowback to a region that is indicative of non-normal activity, such as a kick or a loss. In an exemplary embodiment, the alarm is triggered when the current flowback parameter is greater than the selected smart alarm limit curve. The alarm can be an audible alarm, a visual alarm, or any other suitable alarm.

In one embodiment, the calculated data set is displayed on an X-Y scatter plot at the display and alarm system 150. The dataset values are plotted on the X-Y scatter plot to produce curves for μ, μ+σ, μ−σ, μ+2σ, μ−2σ, μ+Δσ and/or μ−Δσ, as selected by the operator. The current flowback parameter values can also be plotted on the X-Y scatter plot as the values are obtained. The X-Y scatter plot can be provided in real-time to a rig-site, monitoring centers and/or operator or office personnel via remote communications equipment. While the exemplary embodiment plots flowback volume against time, other parameter values such as a pit volume total, a volumetric drilling pit rate changes, etc. can also be plotted in various embodiments. In addition, other curves, such as a difference curve between the current flowback and the average curve, can be plotted in various embodiments.

Figure 2:
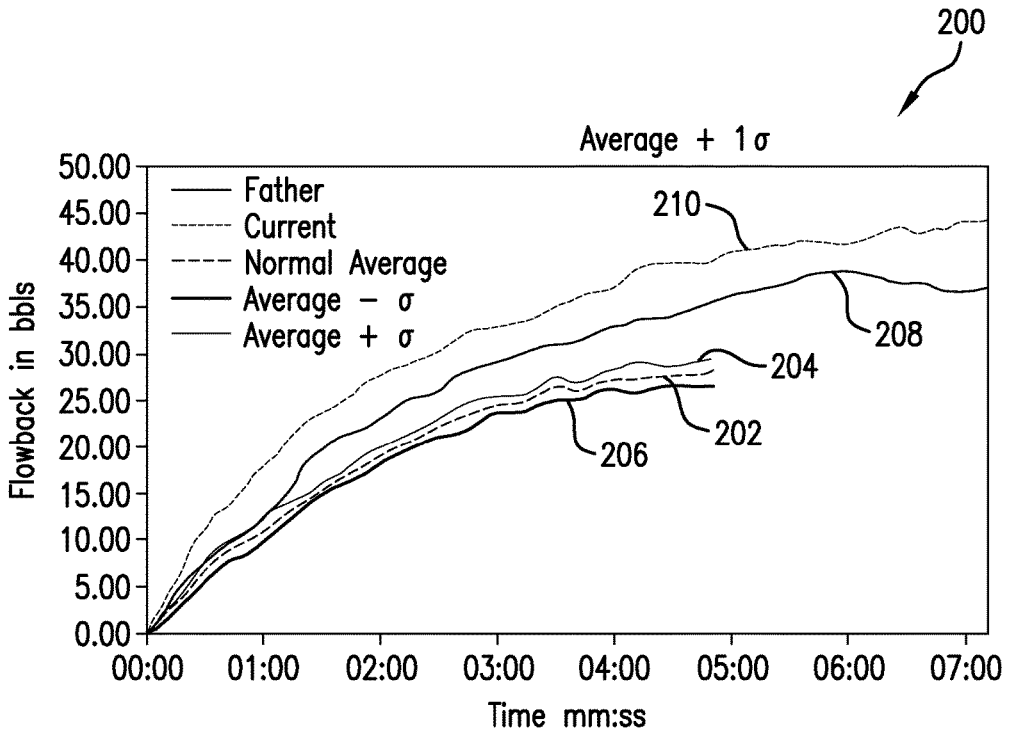
FIG. 2 shows an exemplary plot of dataset curves suitable for implementing a smart alarm according to an embodiment of the present disclosure.

FIG. 2 shows an exemplary plot 200 of dataset curves suitable for implementing a smart alarm according to one embodiment of the present disclosure. The exemplary plot 200 displays flow back volume (in barrels) along the Y-axis and time (in minutes) along the X-axis. An "average" curve 202 indicates the average of flowback curves for a selected number of prior flowbacks. Curves 204 and 206 indicate curves for μ+σ and μ−σ, respectively. In general, 68% of flowback curves will lie within one standard deviation of the average curve, i.e. between curves 204 and curve 206. As seen in FIG. 2, flowback curve 208 ("father curve") and flowback curve 210 ("current curve") are greater at all times than the curve 204 indicating one standard deviation. The term "father curve" is used to indicate the flowback curve that immediately precedes the current curve. Similarly, a "grandfather curve" is used to indicate the flowback curve that immediately precedes the father curve, etc. In FIG. 2, father curve 208 corresponds to a minor kick and current curve 210 corresponds to a major kick. When the operator selects the curve 204 as a smart alarm limit curve, curves 208 and 210 will trigger the alarm at early onset of flowback.

Figure 3:
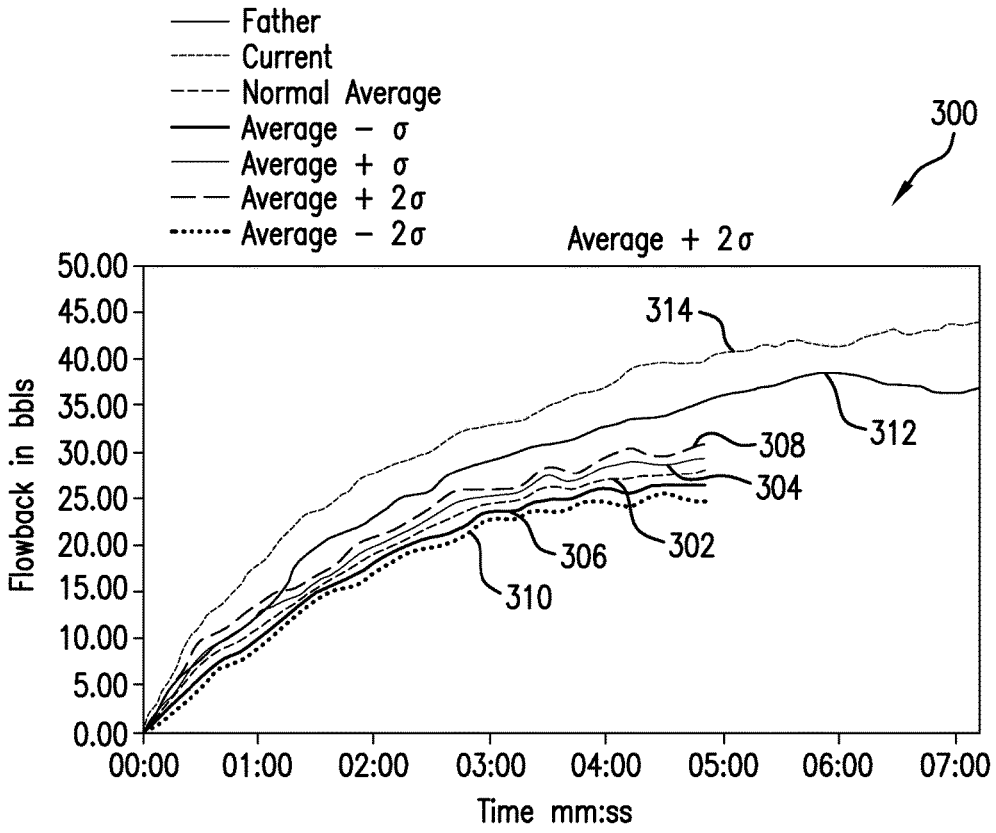
FIG. 3 shows an alternate plot of dataset curves suitable for implementing a smart alarm according to another embodiment of the present disclosure.

FIG. 3 shows an alternate plot 300 of dataset curves suitable for implementing a smart alarm according to another embodiment of the present disclosure. Flowback volume is plotted in barrels along the Y-axis and time is plotted in minutes along the X-axis. Curve 302 represents an average of N previous flowbacks. Curves 304 and 306 indicate +σ and −σ deviations from the average value curve 302. Curves 308 and 310 indicate +2σ and −2σ deviations from the average value curve 302. In general, 95% of normal flowbacks will lie between curves 308 and 310. In FIG. 3, an alarm is set to trigger when a curve leaves the region bounded by curves 308 and 310, such as by crossing above the μ+2σ curve 308 or below the μ−2σ curve 310. Father flowback curve 312 (representing a minor kick) crosses above curve 308 at about 1 minute after onset. Thus, curve 312 triggers an alarm at about one minute after onset of flowback. Current curve 314 (representing a major kick) is above the μ+2σ curve 308 almost from the onset of flowback. Thus, curve 314 triggers an alarm almost as soon as the onset of flowback occurs.

In another embodiment, a determination can be made whether a curve that crosses an alarm curve is a false positive. Some normal flowbacks can leave a "normal" region defined by a selected upper bound curve and lower bound curve for a brief time only to cross back into the normal region. Therefore, in one embodiment, a timer can be started when a flowback curve leaves the normal region to determine how long the current flowback curve remains outside of the normal region. An out-of-bounds time threshold can be selected, for instance, 30 seconds. Therefore, if the current flowback curve remains outside of the normal region for more than 30 seconds, an alarm is triggered. This method can also be used for flowback curves that rise above an upper bound curve or drop below a lower bound curve.

In another embodiment, an alarm limit can be set by the operator using a fixed limit. When a difference between the current curve and the average curve exceeds a fixed threshold value, the alarm is triggered. An exemplary threshold value may be 5 barrels, so that when the current curve differs from the average curve by 5 barrels, the alarm is triggered to indicate a kick.

Figure 4:
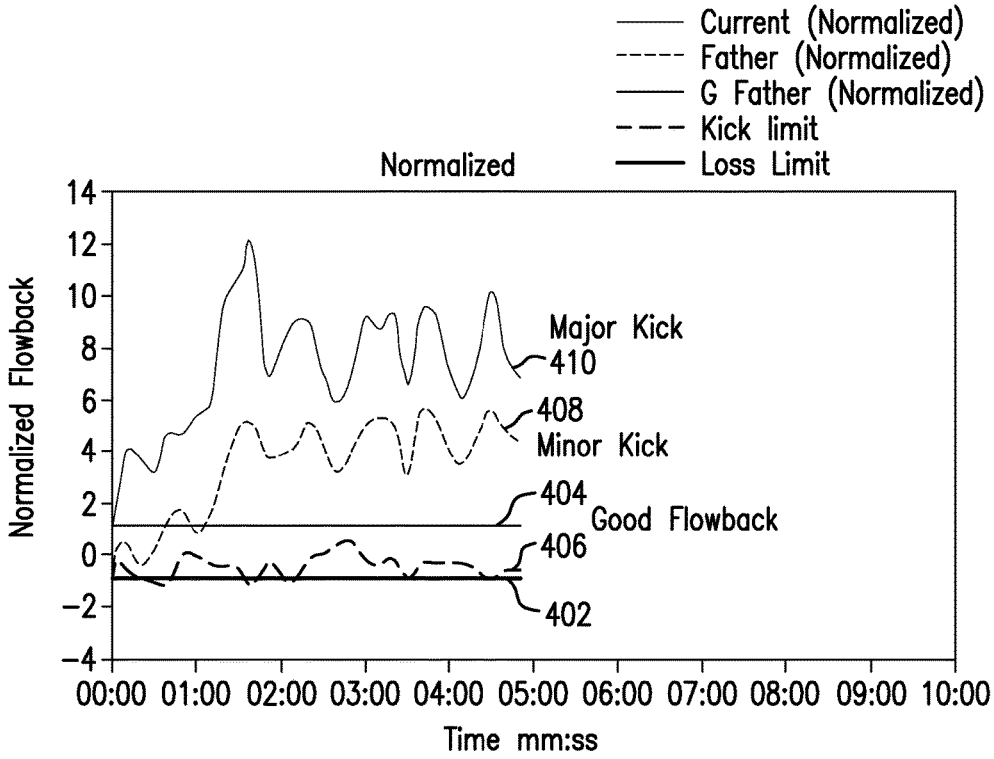
FIG. 4 shows another plot that can be used in another embodiment of the present disclosure for implanting a smart alarm system.

FIG. 4 shows another X-Y scatter plot 400 that can be used in another embodiment of the present disclosure. In the X-Y scatter plot 400, normalized flowback is plotted along the Y-axis and time is plotted in minutes along the X-axis. The normalized display can be a more intuitive display for a human operator than the displays of FIGS. 2 and 3. Normalized curves can be calculated using Eq. (3) below:

$$\Delta = \frac{x-\mu}{\sigma} \qquad \text{Eq. (3)}$$

Upper and lower bound curves, such as 204 and 206 in FIG. 2 appear as straight lines 404 and 402, respectively. The average value is indicated as y=0 on the plot 400. Therefore, line 204 (y=+1) indicates one standard deviation from the normal value. Line 206 (y=−1) indicates −1 standard deviation from the normal value. Curves 406, 408 and 410 represent normalized curves for a good flowback, a flowback having a minor kick and a flowback having a major kick, respectively. For the normalized display, an alarm is triggered when the flowback crosses either above the $\mu+\sigma$ line 404 or below the $\mu-\sigma$ line 402.

Therefore, in one aspect, the present disclosure provides a method of determining an influx at a wellbore, the method including obtaining a flowback parameter for plurality of flowback events at the wellbore prior to a current flowback event; determining an average of the flowback parameter ($\mu$) and a standard deviation ($\sigma$) of the flowback parameter from the plurality of prior flowback parameters; setting an alarm threshold based on the determined average and the standard deviation; measuring a current flowback parameter; and determining the influx when the current flowback parameter meets the alarm threshold. The method may further determine a kick when the current flowback parameter is greater than $\mu+\Delta\sigma$, where $\Delta$ is a positive number; and determine a loss when the current flowback parameter is less than $\mu-\Delta\sigma$, where $\Delta$ is a positive number. In various embodiments, the determined average is a moving average of one of: (i) a selected number of prior flowback measurements; and (ii) prior flowback measurements occurring within a selected time period prior to the current flowback event. An action can be performed to reduce influx when the flowback parameter meets the alarm threshold. In one embodiment, a duration of time that the current flowback parameter exceeds the alarm threshold can be measured and the influx is determined when the measured time duration exceeds a selected time threshold. The current flowback parameter and the alarm threshold can be displayed as one of: (i) a graph of the parameter vs. time; and (ii) a normalized graph of the parameter vs. time. On the normalized graph, the alarm threshold appears as a straight line. The average can be one of: (i) an arithmetic mean; (ii) a geometric mean; and (iii) a weighted average.

In another aspect, the present disclosure provides an apparatus for determining an influx at a wellbore, the apparatus including: a sensor configured to obtain a parameter of a current flowback; and a processor configured to: determine an average flowback parameter ($\mu$) and a standard deviation ($\sigma$) of the parameter for prior flowbacks, set an alarm threshold based on the determined average and standard deviation, compare the measured current parameter to the alarm threshold, and trigger an alarm to indicate the influx when the current parameter meets the alarm threshold. The processor can further determine a kick when the current parameter is greater than $\mu+\Delta\sigma$, where $\Delta$ is a positive number and determine a loss when the current parameter is less than $\mu-\Delta\sigma$, where $\Delta$ is a positive number. The determined average can be a moving average of one of: (i) a selected number of prior flowback measurements; and (ii) prior flowback measurements occurring within a selected time period immediately prior to the current flowback. The processor can further perform an action to reduce influx when the flowback parameter meets the alarm threshold. The processor can further measure a duration of time that the current parameter exceeds the alarm threshold and determine the influx when the measured duration of time exceeds a selected time threshold. The processor can further display the current parameter and the alarm threshold on one of: (i) a graph of the parameter vs. time; and (ii) a normalized graph of the parameter vs. time. The alarm threshold appears as a straight line on the normalized graph. In various embodiments, the processor determines an average that is one of: (i) an arithmetic mean; (ii) a geometric mean; and (iii) a weighted average.

In yet another aspect, the present disclosure provides a computer-readable medium accessible to a processor and having instructions stored thereon that when read by the processor enable the processor to perform a method of determining an influx at a wellbore, the method including: obtaining a flowback parameter for plurality of flowback events at the wellbore prior to a current flowback event; determining an average of the flowback parameter ($\mu$) and a standard deviation ($\sigma$) of the flowback parameter from the plurality of prior flowback parameters; setting an alarm threshold based on the determined average and the standard deviation; measuring a current flowback parameter; and determining the influx when the current flowback parameter meets the alarm threshold. The current flowback parameter and the alarm threshold can be displayed on one of: (i) a graph of the parameter vs. time; and (ii) a normalized graph of the parameter vs. time, in various embodiments. Additionally, the processor may perform an action to reduce influx when the flowback parameter meets the alarm threshold.

As noted above, the drilling system 100 can also verify or confirm an alarm signifying a kick or loss using sensor data obtained downhole. A kick relates to an amount of fluid flow in the annulus to the surface that is above an expected amount and a commensurate increase in annulus pressure above normal levels for the increased amount of fluid flow to occur. Hence, a measurement of annulus pressure above a threshold value can indicate the occurrence of a kick. Similarly, an increase in differential pressure between the annulus pressure and the internal drill string pressure to above a threshold value may also indicate the occurrence of a kick. Consequently, annulus pressure measurements and/or differential pressure measurements between annulus pressure and internal drill string pressure can be used to verify or confirm kick detection by the surface control unit 140 and/or the display and alarm system 150. The threshold value may be based on an expected normal pressure values obtained from previous pressure and/or differential pressure data obtained when a kick did not occur. In addition, other downhole annular sensor measurements or calculated differential measurements (including but not limited to temperature) obtained during the same time interval can be telemetered and compared against previous measurements to detect abnormal influxes of fluids or gases which have entered the annulus of the borehole.

Regarding a loss, a loss relates to amount of fluid flow in the annulus to the surface that is below an expected amount and may result from borehole fluid entering crevices and cavities opened up by drilling the borehole. Because less borehole fluid is flowing to the surface in the annulus, the annulus pressure is less than expected. Hence, a measurement of annulus pressure above a threshold value can indicate the occurrence of a kick. Similarly, a decrease in differential pressure between the annulus pressure and the internal drill string pressure to below a threshold value may also indicate the occurrence of a loss. Consequently, annulus pressure measurements and/or differential pressure measurements between annulus pressure and internal drill string pressure can be used to verify or confirm loss detection by the surface control unit 140 and/or the display and alarm system 150. The threshold value may be based on an expected normal pressure values obtained from previous pressure and/or differential pressure data obtained when a loss did not occur. Other annular and internal drill string measurements, including but not limited to temperature, obtained during the same time interval can be also be used to verify the surface detection algorithm.

Figure 5:
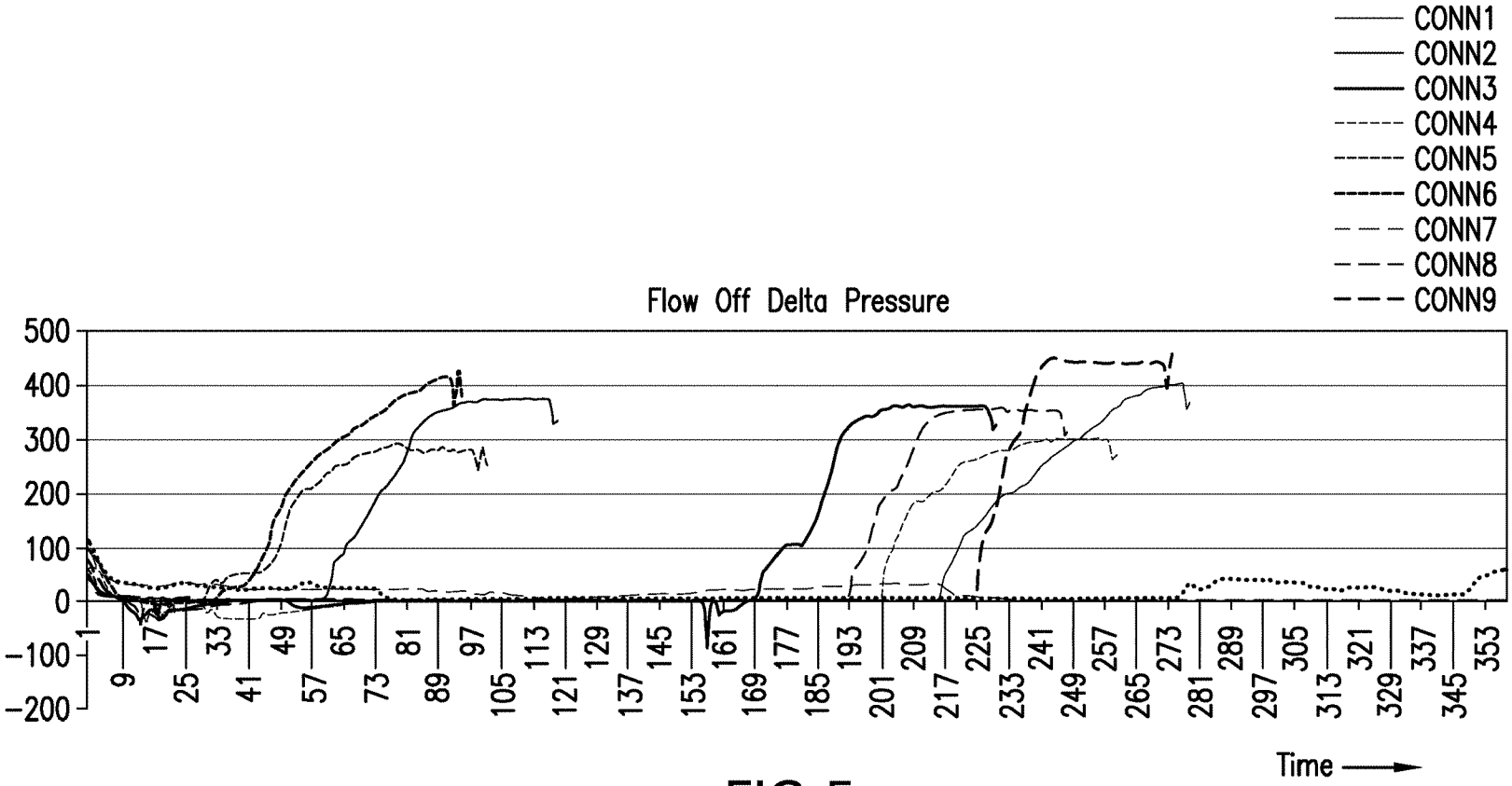
FIG. 5 shows a plot of flow off delta pressure versus time for various connection intervals.
Figure 6:
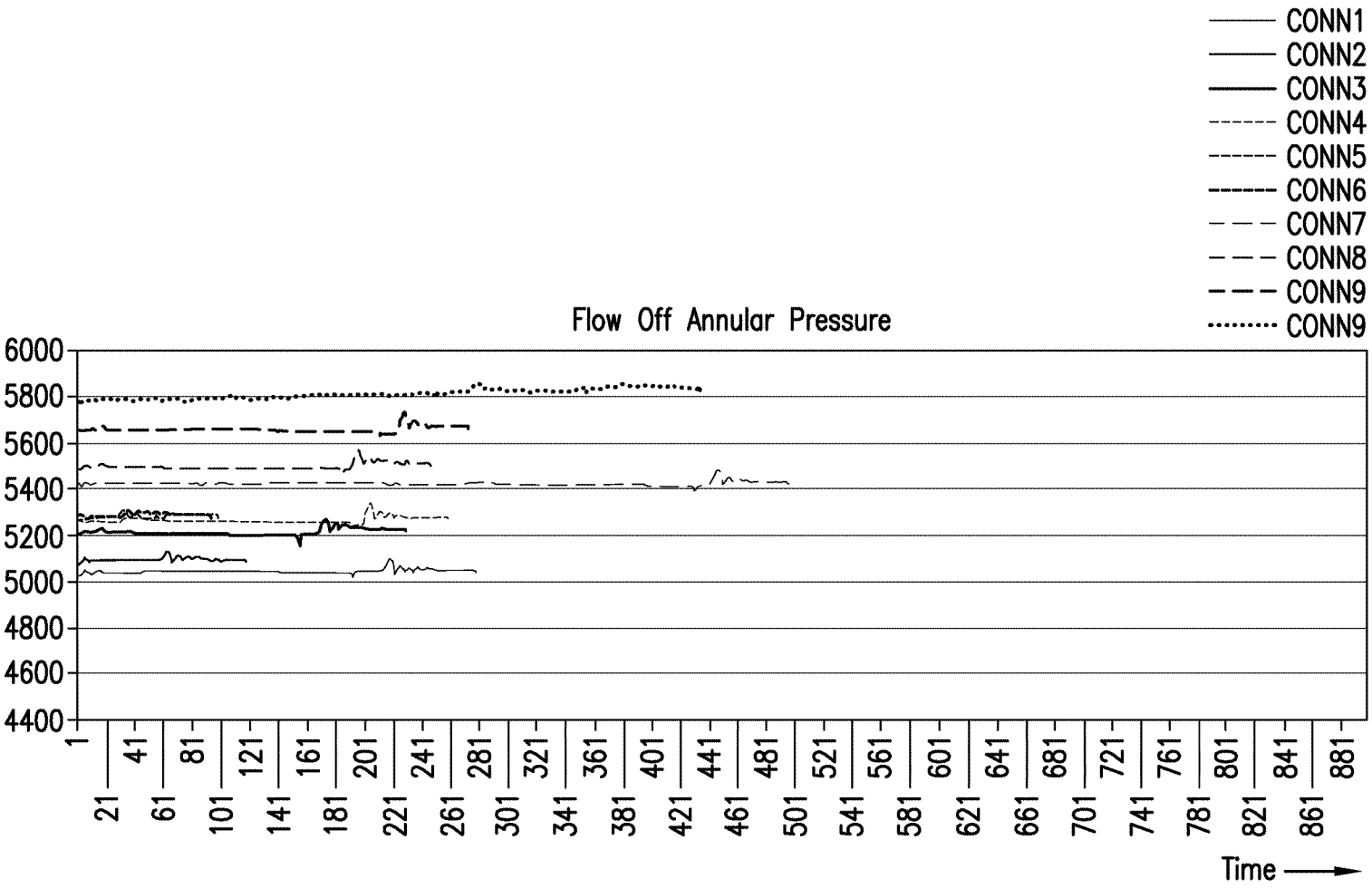
FIG. 6 shows a plot of flow off annular pressure versus time for various connection intervals.

Threshold values for kick or loss verification may be determined by analysis noting the fluid mechanics required for a kick or loss to occur or from past pressure and/or differential pressure data when kick or loss did not occur and drilling fluid was not being pumped. In one or more embodiments, the verifier controller 163 executes an algorithm that includes an upper threshold value which when exceeded by sensed downhole pressure values verifies detection of a kick by the surface equipment. Similarly in one or more embodiments, the verifier controller 163 executes an algorithm that includes an lower threshold value which when exceeded in a downward direction by sensed downhole pressure values verifies detection of a loss by the surface equipment. The lower threshold value generally has a lower value than the upper threshold value. In one or more embodiments, the upper threshold value is an average value of annulus pressure or differential pressure between the annulus pressure and the drill string internal pressure plus a margin. The pressure values for the average value are those values obtained when a kick or loss did not occur and drilling fluid was not being pumped. The average value may be one of: (i) an arithmetic mean; (ii) a geometric mean; and (iii) a weighted average. The arithmetic mean may be calculated using equation (1) where $x_1, x_2, \ldots, x_N$ are the last N pressure or differential pressure data samples, with $x_1$ being the most recent pressure or differential pressure sample and $x_N$ being the oldest pressure or differential pressure sample. In one or more embodiment , this average (and subsequent standard deviation) is calculated by excluding special events like kicks, losses, flowchecks, SCR's (slow circulation rates), etc. In one or more embodiments, the value of N is selected to be 7. However, the number N can be any number that is suitable to an operator. Pressure data that may be used to calculate average annulus pressure or differential pressure is illustrated in FIGS. 5 and 6. FIG. 5 shows a plot of flow off delta pressure values versus time for various connection intervals (i.e., time intervals where drill pipe connections are being made and drilling fluid is not being pumped). FIG. 6 shows a plot of flow off annular pressure values versus time for various connection intervals. It can be seen in FIG. 6 that the more connections that are made as the borehole is drilled deeper, the higher the normal annular pressure is due to the static head of borehole fluid. Hence, the verifier controller 163 may be configured to adjust the upper and lower threshold values to take into the account the static head at the current depth of the borehole by receiving the current borehole depth as an input. Pressure or differential pressure values used to calculate the average value are generally obtained under static or near-static pressure or differential pressure conditions and not under transient conditions such as those illustrated in FIG. 5 at the beginning of a connection.

It can be appreciated that low margin values will insure that actual kicks or losses when they occur will in fact be verified. However, if the margin values are too low, then detection of kicks or losses that did not actually occur may end up being verified. Thus, margin values are selected to provide a desired balance between verification of actual kicks or losses and false verification of kicks or losses that did not actually occur. The margin value for determining the upper threshold can be the same as or different from the margin value for determining the lower threshold depending on the desired balance for verifying kicks and losses. In one or more embodiments, the margin value is based on the standard deviation ($\sigma_P$) of the values used to determine the average value. The standard deviation may be calculated using Equation (2) where $x_i$ represents the pressure or differential pressure of the i-th sample and $\mu$ represents the average value of pressure or differential pressure. In one or more embodiments, the margin is calculated by multiplying a positive value ($\Delta_P$) times the standard deviation ($\sigma_P$), $M=\Delta_P\cdot(\sigma_P)$. Hence, in one or more embodiments, the upper threshold$=\mu+M$, while the lower threshold$=\mu-M$. In one or more embodiments, $\Delta_P$ can equal an integer so that the margin is a multiple of the standard deviation. In one or more embodiments, $\Delta_P$ is equal to two to achieve the desired balance where most if not all actual kicks or losses are verified.

Figure 7:
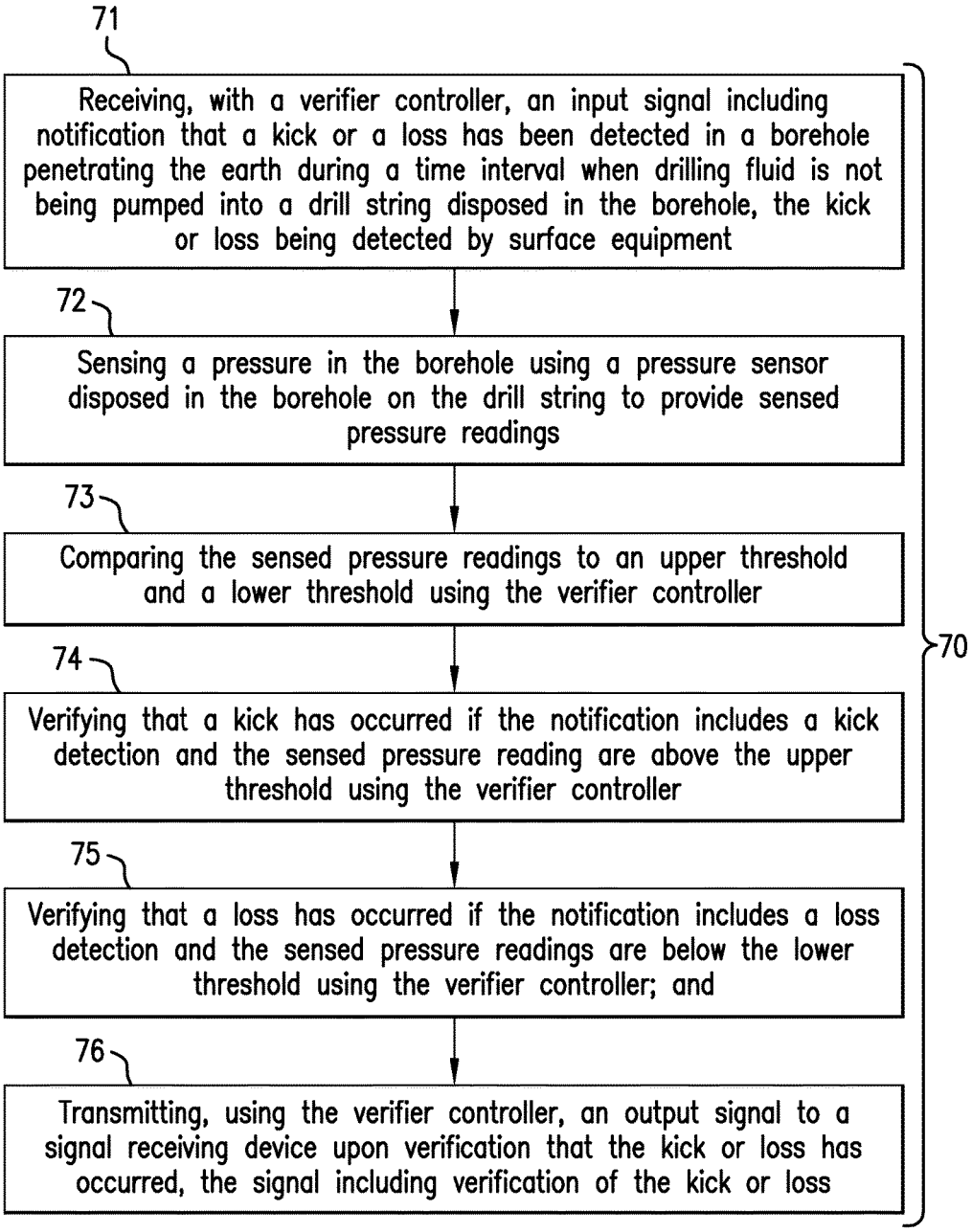
FIG. 7 is a flow chart of a method for confirming a kick or loss during a connection interval.

FIG. 7 is a flow chart for a method 70 for verifying that a kick or loss detected by surface monitoring equipment has occurred. Block 71 calls for receiving, with a verifier controller, an input signal comprising notification that a kick or a loss has been detected in a borehole penetrating the earth during a time interval when drilling fluid is not being pumped into a drill string disposed in the borehole, the kick or loss being detected by the surface equipment. Non-limiting examples of the surface equipment include the drilling fluid storage system 104, the sensors S1-S4, the surface control unit 104 and the display and alarm system 150. Block 72 calls for sensing a pressure in the borehole using a pressure sensor disposed in the borehole on the drill string to provide sensed pressure readings. In one or more embodiments, the sensed pressure is annular pressure and/or differential pressure between the annulus pressure and internal drill string pressure. Block 73 calls for comparing the sensed pressure readings to an upper threshold and a lower threshold using the verifier controller. Comparing may include calculating a difference between values of the sensed pressure reading and the upper threshold and/or lower threshold such that a kick is verified if the difference is positive and loss is identified if the difference is negative. Block 74 calls for verifying that a kick has occurred if the notification comprises a kick detection and the sensed pressure reading are above the upper threshold using the verifier controller. Block 75 calls for verifying that a loss has occurred if the notification comprises a loss detection and the sensed pressure readings are below the lower threshold using the verifier controller. Block 76 calls for transmitting, using the verifier controller, an output signal to a signal receiving device upon verification that the kick or loss has occurred, the signal comprising verification of the kick or loss. In one or more embodiments, the signal receiving device is a surface controller configured to perform an action commensurate with the detection of the kick or loss upon receiving the input signal that comprises notification of detection of the kick or loss and the output signal that comprises verification that the kick or loss has occurred. In one or more embodiments, the signal receiving device is a display configured to display the verification to a user that the kick or loss has occurred.

One advantage provided by verification of a kick or loss detected by the surface equipment relates to additional assurance that a kick or loss has actually occurred before potentially expensive measures are taken to limit the consequences of or remediate the occurrence of the kick or loss.

In support of the teachings herein, various analysis components may be used, including a digital and/or an analog system. For example, the surface control unit 140, the display and alarm system 150, and or the downhole electronics 161 may include digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for verifying that a kick or loss detected by surface monitoring equipment has occurred, the method comprising:

receiving, with a verifier controller, an input signal comprising notification that a kick or a loss has been detected in a borehole penetrating the earth during a time interval when drilling fluid is not being pumped into a drill string disposed in the borehole, the kick or loss being detected by the surface equipment;

sensing a pressure in the borehole using a pressure sensor disposed in the borehole on the drill string to provide sensed pressure readings;

comparing the sensed pressure readings to an upper threshold and a lower threshold using the verifier controller;

calculating an average of prior sensed pressure readings during a time interval when drilling fluid is not being pumped into the drill string and a kick and loss has not occurred;

calculating the upper threshold by adding a first margin to the average;

calculating the lower threshold by subtracting a second margin from the average;

verifying that a kick has occurred if the notification comprises a kick detection and the sensed pressure reading are above the upper threshold using the verifier controller;

verifying that a loss has occurred if the notification comprises a loss detection and the sensed pressure readings are below the lower threshold using the verifier controller;

transmitting, using the verifier controller, an output signal to a signal receiving device upon verification that the kick or loss has occurred, the signal comprising verification of the kick or loss; and performing a physical action commensurate with the detection and verification of the kick or loss using a drilling system, the physical action configured to at least one of limit consequences of and remediate occurrence of the kick or loss.

2. The method according to claim 1, wherein the pressure in the borehole comprises at least one of an annulus pressure and a differential pressure between an annulus pressure and a drilling fluid pressure internal to the drill string.

3. The method according to claim 1, wherein the margin is a number multiplied times a standard deviation of the prior sensed pressure readings during a time interval when drilling fluid is not being pumped into the drill string and a kick has not occurred.

4. The method according to claim 3, wherein the number is an integer.

5. The method according to claim 4, wherein the integer is two.

6. The method according to claim 1, wherein the margin is a positive number multiplied times a standard deviation of the prior sensed pressure readings during a time interval when drilling fluid is not being pumped into the drill string and a loss has not occurred.

7. The method according to claim 3, wherein the number is an integer.

8. The method according to claim 4, wherein the integer is two.

9. The method according to claim 1, wherein the signal receiving device is a display and alarm system configured to transmit an alarm to a user notifying the user of a kick or loss upon receiving the output signal.

10. The method according to claim 1, further comprising transmitting a kick or loss detection and verification signal to a surface controller configured to perform the physical action commensurate with the detection and verification of the kick or loss.

11. An apparatus for verifying that a kick or loss detected by surface monitoring equipment has occurred, the apparatus comprising:

a pressure sensor disposed in a borehole on a drill string and configured to sense pressure to provide sensed pressure readings;

a verifier controller configured to:

receive an input signal comprising notification that a kick or a loss has been detected in a borehole penetrating the earth during a time interval when drilling fluid is not being pumped into the drill string disposed in the borehole, the kick or loss being detected by the surface equipment;

compare the sensed pressure readings to an upper threshold and a lower threshold;

calculate an average of prior sensed pressure readings during a time interval when drilling fluid is not being pumped into the drill string and a kick and loss has not occurred;

calculate the upper threshold by adding a first margin to the average;

calculate the lower threshold by subtracting a second margin from the average;

verify that a kick has occurred if the notification comprises a kick detection and the sensed pressure reading are above the upper threshold using the processor;

verify that a loss has occurred if the notification comprises a loss detection and the sensed pressure readings are below the lower threshold using the processor; and transmit an output signal to a signal receiving device upon verification that the kick or loss has occurred, the signal comprising verification of the kick or loss;

a drilling system configured to perform a physical action commensurate with the detection and verification of the kick or loss, the physical action configured to at least one of limit consequences of and remediate occurrence of the kick or loss.

12. The apparatus according to claim 11, wherein the pressure sensor is configured to sense at least one of an annulus pressure and a differential pressure between an annulus pressure and a drilling fluid pressure internal to the drill string.

13. The apparatus according to claim 11, further comprising a display and alarm system configured to receive kick or loss detection data from a surface controller and to transmit the input signal upon detection of the kick or loss.

14. The apparatus according to claim 13, wherein the display and alarm system comprises a logical AND circuit configured to output a kick or loss detection and verification signal upon receiving a first input that a kick or loss was detected using the data from the surface controller and a second input that comprises the output signal.

15. The apparatus according to claim 14, wherein the surface controller is configured to perform the physical action commensurate with the detection of the kick or loss upon receiving the kick or loss detection and verification signal.

16. The apparatus according to claim 11, wherein the verifier controller is configured to calculate the first margin by calculating a standard deviation of the prior sensed pressure readings during a time interval when drilling fluid is not being pumped into the drill string and a kick has not occurred, and the first margin is a number multiplied times the standard deviation.

17. The apparatus according to claim 11, wherein the verifier controller is further configured to calculate the second margin by calculating a standard deviation of the prior sensed pressure readings during a time interval when drilling fluid is not being pumped into the drill string and a kick has not occurred, and the second margin is a number multiplied times the standard deviation.

* * * * *